United States Patent [19]

Fauls

[11] 4,236,347

[45] Dec. 2, 1980

[54] FLEXIBLE DOLL CLOSURE AND HEAD MOUNTING

[75] Inventor: Thomas J. Fauls, West Orange, N.J.

[73] Assignee: Mego Corp., New York, N.Y.

[21] Appl. No.: 51,628

[22] Filed: Jun. 25, 1979

[51] Int. Cl.[3] ..... A63H 3/00

[52] U.S. Cl. ..... 46/156; 46/164; 46/173

[58] Field of Search ..... 46/151, 162, 164, 173, 46/156

[56] References Cited

U.S. PATENT DOCUMENTS

| | | | |
|---|---|---|---|
| 267,212 | 11/1882 | Johnson | 46/164 |
| 1,346,176 | 7/1920 | Chambers | 46/156 X |
| 4,143,453 | 3/1979 | Taluba | 46/164 X |
| 4,169,336 | 10/1979 | Kuhn | 46/156 |

FOREIGN PATENT DOCUMENTS

| | | | |
|---|---|---|---|
| 937936 | 1/1956 | Fed. Rep. of Germany | 46/173 |
| 949397 | 9/1956 | Fed. Rep. of Germany | 46/173 |
| 1354189 | 5/1974 | United Kingdom | 46/164 |

*Primary Examiner*—F. Barry Shay

[57] ABSTRACT

A flexible doll having a normal form defined by a molded elastic skin and viscous liquid filler and a separate molded head, and which will repeatedly return to its normal form after stretching and deforming of its body parts, is provided with a closure means and head mounting which is a cylindrical member having a large diameter filling passage, and external circumferential flanges spaced along its length. Two of the flanges provide a recess for clamping the doll skin thereto in sealed relationship. End flanges on the cylindrical member coact with a cylindrical bore and flange on the doll head to support it in a manner to be erect and rotatable with respect to the doll body. A plug is provided for sealingly closing the filler passage. The plug is apertured so that the doll body may be squeezed to remove all air therefrom prior to closing the aperture.

This invention relates to a flexible doll having a normal form defined by a molded elastic skin and viscous liquid filler and a separate molded head, and which will repeatedly return to its normal form after stretching and deforming of its body parts, and having closure means which both facilitates filling of the skin with viscous liquid and effectively engages and supports the head in a manner to be erect and rotatable with respect to the doll body.

6 Claims, 4 Drawing Figures

FLEXIBLE DOLL CLOSURE AND HEAD MOUNTING

BACKGROUND OF THE INVENTION

It has long been known that dolls, here intended to include animated figures generally, can be made of flexible material, in three dimensional form, in a manner to permit repeated distortion and return to the original form. Probably the oldest types are hollow rubber skins of stable molded contour which can be deformed by expelling air through a small opening, and which will return to the original form as the "memory" of the stable contour acts to draw in air through the small opening. As representative of this type of device attention is directed to U.S. Pat. No. 2,817,187.

Another approach has been to fashion dolls from a solid molded mass of flexibly resilient material containing a resiliency-retarding ingredient as disclosed in U.S. Pat. No. 2,830,402. This approach permits free axial bending, with slow return to original form, but permits only limited axial stretching of parts.

A more recent approach, as exemplified by U.S. Pat. No. 3,601,923, is to provide a hollow molded shell or skin of elastically deformable material and fill it, to its original molded size and contour, with a viscous liquid medium which will flox slowly as external forces distort the skin, and as the distorted skin returns to the configuration or "memory" of its originally molded contour. The viscous medium of the above mentioned patent comprises an appropriate aqueous suspension of particles of cornstarch or tapioca starch. The result of such a composite structure is that portions of the assemblage, such as arms and legs of a doll simulating a human figure can be repeatedly bent and stretched, while slowly returning to original configuration as the applied force is released.

As applied to a simulated human figure, FIG. 4 of the above identified patent, the head portion is described as part of the composite structure, i.e., being part of the container or skin and filled with the viscous medium. In similar dolls seen in the marketplace the head has been a separate part fixedly secured to the container or skin. Both of these treatments of the head portion of a stretchable doll have distinct limitations, as neither will permit the user to maintain a change or adjustment in the head orientation. The former, if adjusted, will promptly return to its original configuration, and the latter, fixed head mounting, prevents any adjustment.

THE INVENTION

In accordance with the present invention, a flexible doll having a normal form defined by a molded elastic skin and viscous liquid filler and a separate molded head, and which will repeatedly return to its normal form after stretching and deforming of its body parts, is provided with closure means which both facilitates filling of the skin with viscous liquid and effectively engages and supports the head in a manner to be erect and rotatable with respect to the doll body. The elastic skin terminates in an open neck portion, and the closure means comprises hollow cylindrical member having central and closely spaced circumferential flanges forming a channel to clampingly receive said open neck portion. Adjacent to the outer end of said cylindrical member is a third circumferential flange with radial protrusion slightly greater than that of the central flanges, while at the inner end of said member is a fourth circumferential flange which protrudes radially beyond the other three.

The cylindrical member provides a large passage for feeding viscous fluid into the molded skin, and the spacing between said central flanges and third flange facilitates gripping of the assemblage by automatic filling equipment. After filling to a predetermined level the outer end of said cylindrical member is closed by a sealing plug having a small diameter bleed tube protruding therefrom which is sealed off after all air has been vented from the assemblage.

The third and fourth circumferential flanges provide means for attaching to the assemblage a molded head having a cylindrical bore extending partly therethrough and terminating at its inner end in an inwardly and angularly disposed flexible circumferential flange. The third and fourth flanges on said cylindrical member are respectively slightly smaller than and slightly greater than the diameter of the bore in said head, and the opening formed by the flexible flange in said bore is slightly smaller than said third flange. As a further and critical detail, the distance between the inner edge of said flexible flange and the outer end of said bore is slightly less than the distance between said third and fourth flanges so that as the head coaxially lowered over the cylindrical member of the assemblage, and force is applied to slide the flexible flange of the bore over said third flange there will be slight clearance between the outer end of said bore and the skin of said assemblage as it is positioned by said fourth flange.

This head mounting permits free rotation of the head while essentially eliminating any tilting movement. Furthermore, the interlock between the head and cylindrical member is such as to permit the head to be grasped as a leg, arm or other body part is pulled to stretch and distort the same. By way of example, if the doll is stretched holding the head and both feet, the legs and waist position will be lengthened and narrowed to permit pants of be slipped onto the doll and become snug fitting as the doll returns to its original contour.

While various resiliently elastic moldable materials can be employed in making the skin portion of the doll, it is preferable to employ rubber latex which, in the cured state, provides excellent resiliency and "memory", assuring repeated return of stretched or deformed material to its initial molded contour. As a measure of suitability for use in fabricating the stretchable dolls, a molded skin when clamped at the end portions thereof should be able to withstand 500 cycles of 300% elongation and relaxation to original length and still have "memory" to return to its original molded contour.

The viscous fluid used to fill the skin to assemble the stretchable doll preferably has a viscousity within the range of about 48 to 49 degrees Baume. While various viscous fluids can be employed, a combination of satisfaction in use and safety in the event of accidental spillage or leakage is achieved when using commercial evaporated corn syrup which has been further evaporated to obtain the viscosity desired for a particular application. It should be noted in this connection that because of the number of variables involved such as doll size, the size of arms, legs or other body parts, and the rapidity of return to normal contour desired after stretching, it is not considered particularly helpful to designate particular viscosities within the range above mentioned. Anyone practicing the invention can readily determine with a particular molded skin available, what viscosity will provide the type performance desired.

Stretchable dolls, in accordance with the present invention, in addition to providing varied amusement through stretching and distorting a doll, can also provide a meaningful source of exercise. As the force needed to produce a predetermined stretching increases as the viscosity of the liquid filler is increased, it will be apparent that in instances where the exerciser function of the doll is considered predominant one should lean toward a somewhat higher viscosity in the filling fluid than in instances were a doll is intended primarily as a source of amusement.

Novel features of the improved stretchable doll will be more fully understood from a consideration of the following description having reference to the accompanying drawing, in which structural details have been identified by suitable reference characteristics in each of the views and in which.

Figure 1:
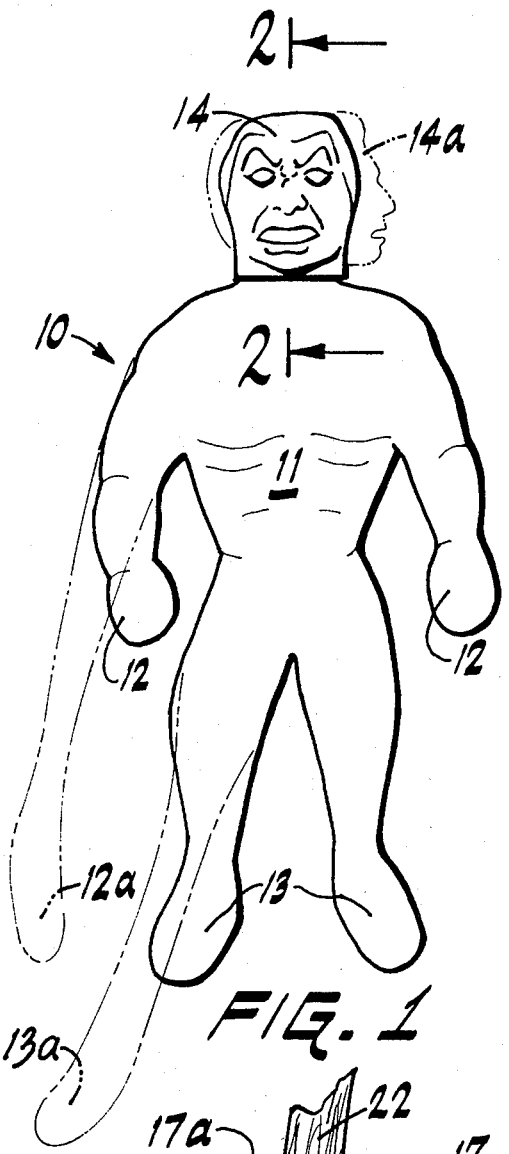
FIG. 1 is a front elevation view of a stretchable doll in accordance with the invention with the dotted showing of the head structure indicating the rotation thereof.

As shown in the drawing a stretchable doll 10, in this instance simulating a human figure and having a body portion 11, arms 12, and legs 13 is elastically deformable as indicated by the stretched, dotted line showing of arm 12*a* and leg 13*a*, but characterized in that the deformed parts will slowly return to their original configuration. The doll is provided with a seperate head 14 which is rotatable with respect to the body portion 11 as indicated by the dotted line showing 14*a*.

Figure 2:
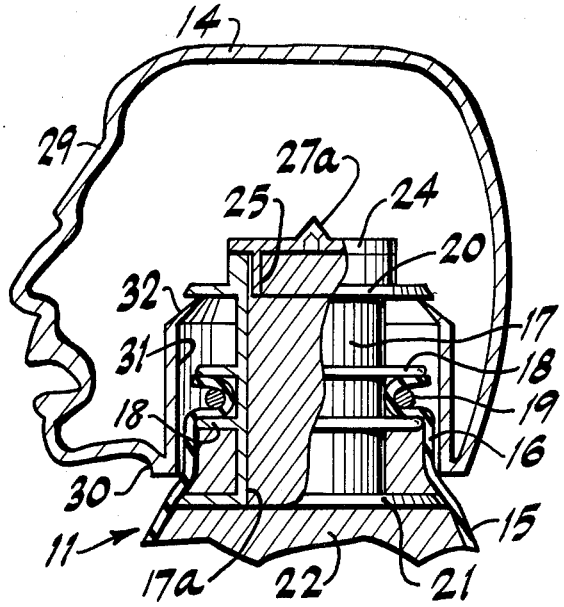
FIG. 2 is a fragmentary sectional view substantially on the line 2—2 of FIG. 1.

As more clearly shown in FIG. 2 of the drawing the body portion 11 and associated arms 12 and legs 13 comprises a skin or casing 15 of resiliently elastic material which is molded to the particular form and configuration desired in the body portion of the doll. The skin or casing 15 terminates at the upper end in a neck portion 16 which, for sealing and head mounting purposes, is passed over the hollow cylindrical member 17 and secured between central radial flanges 18 by a circumferential clamp 19. If desired, the neck portion 16 can be extended beyond upper flange 18 to facilitate a second clamping engagement as indicated at 19*a* in FIG. 4.

The cylindrical member 17 is provided, adjacent its upper end with a third flange 20 of slightly larger diameter than the flange 18, and at its lower end with a fourth flange 21 which is a still larger diameter.

Figure 3:
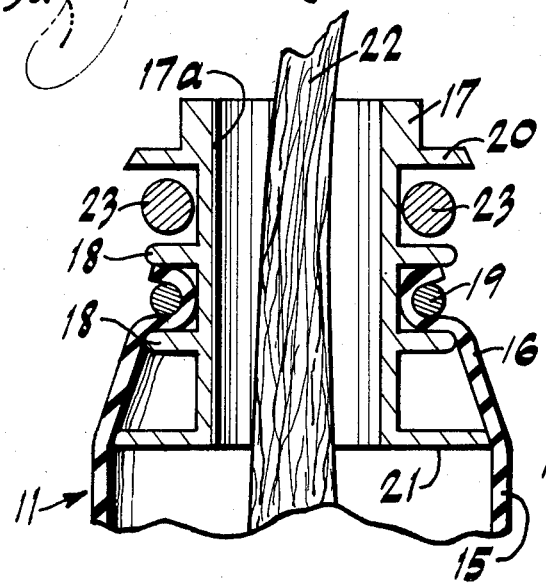
FIG. 3 is an enlarged view similar to FIG. 2 with the head detached and showing the parts as at the start of the filling operation.
Figure 4:
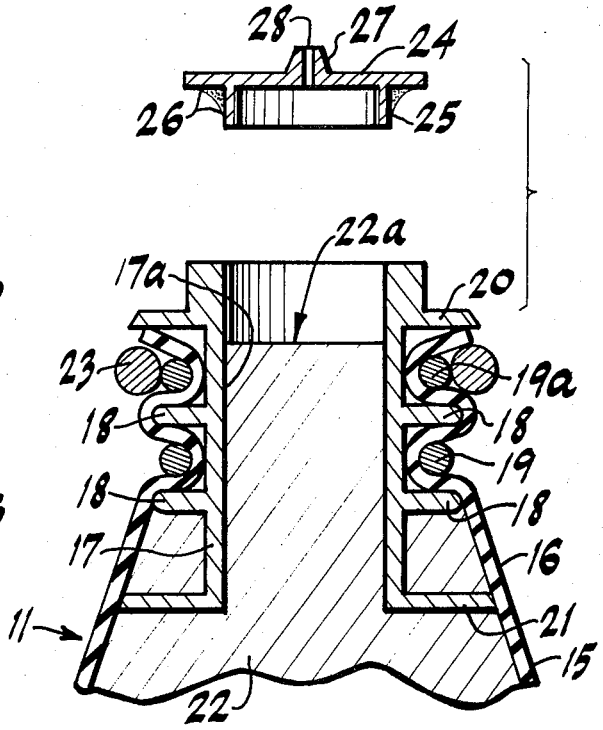
FIG. 4 is a view similar to FIG. 3 showing the parts as at the end of the filling operation and prior to final sealing.

After attaching the skin or casing 15 to the cylindrical member 17 to provide the sub-assemblage shown in FIGS. 3 and 4, the casing is filled with a viscous fluid 22, fed through the central passage 17*a* of the cylindrical member 17. This step can be readily handled by automatic filling equipment having appropriate grippers 23, engaging the exterior flanged contour of the member 17. The viscous fluid 22 can suitably comprise evaporated corn syrup having the desired viscosity as earlier described, and filling is continued until the entire skin or casing 15 has been filled including the neck portion 16 above flange 21 and the central passage 17*a* of the cylindrical member 17 has been filled to a pre-determined level 22*a* as shown in FIG. 4. In automatic filling the sub-assemblage would then be moved to another station for applying closure plug 24, having an annular, axially extending flange 25 fitting telescopically within the central passage 17*a* of the cylindrical member 17 and secured to the cylindrical member 17 as by the annular deposit cement 26. The plug 24 is provided with a central extension 27 having a bleed hole 28 through which air can be evacuated, after mounting of the plug 24, by applying slight pressure to the filled skin 15 to raise the liquid level 22*a* into the bleed hole 28. The bleed hole is then sealed to provide the closed configuration of the extension 27 as shown at 27*a* in FIG. 2 of the drawing.

When the skin or casing 15 has thus been filled and sealed, the separate head 14 can be mounted to complete assemblage of the doll 10. As shown in FIG. 2, the head 14 comprises a hollow molded body with the outer wall 29 characterized to provide the intended likeness and terminating in circular neck portion 30 from which there is an upwardly extending integral wall portion providing a cylindrical bore 31 which terminates at its upper and in an inwardly and upwardly inclined flexible flange 32, providing an opening having a diameter smaller than the diameter of flange 20. As will be seen in FIG. 2, the diameter of the bore 31 is slightly larger than the diameter of upper flange 20 of the cylindrical member 17 and also slightly larger than the diameter of the central flanges 19 with the neck portion 16 of the skin overlying the same, but is smaller than the diameter of the lower flange 21 on cylindrical member 17. It will also be noted that the distance between the base of the circular neck portion 30 and the upper extremity of inclined flange 32 is less than the distance between flanges 20 and 21 on the cylindrical member 17.

This relationship of parts and part sizes permits the bore 31 in the head 14 to be freely lowered over the sub-assemblange of skin 15 and cylindrical member 17 until the inclined flange 32 rests upon flange 20. Then slight application of downward force will flex the flange 32 over the flangef 20 to the locked position shown in FIG. 2 which prevents removal of the head 14 but permits its free rotation with respect to the sub-assemblage. It would be noted in this connection that the spacing of the neck portion 30 and extremity of the flange 32 with respect to the spacing of flanges 20 and 21 should be carefully controlled to provide a minimum clearance for the neck portion 16 of the skin to pass between the head and the flange 21. Ideally, there should be slight clearance so that there will not be significant friction and wear through rotation of the head, while at the same time providing co-action between the neck portion 30 of the head and flange 21 to limit tilting movement of the head and maintain it erect with respect to the body portion 11 of the doll.

It will be apparent that this inter-engagement between the head 14 and the flange 20 provides a positive interlock so that one manipulating the doll can grasp the head and pull on the legs or other body parts to stretch the same without danger of disengagement of the head. At the same time the free rotation of the head and its erect support with respect to the body 11 provides great versatility in producing amusing and unusual effects by adjustments of the head respect to particular flexible distortions of the body parts.

Various changes and modifications in the closure means and head mounting for flexible dolls as herein disclosed may occur to those skilled in the art, and to the extent that such changes and modifications are embraced by the appended claims, it is to be understood that they constitute part of the present invention.

What is claimed is:

1. In a figure toy, a closure means and head mounting in which the body portion comprises a molded skin of resiliently elastic material filled with a viscous fluid, and terminates in a wide portion, and the head is a separate hollow member interfitting with said neck portion, and closure means and head mounting comprising an elongated hollow cylindrical member having a plurality of external longitudinally spaced and circumferentially extending flanges, and providing a large diameter filling passage which is closed at the upper end thereof when filling is completed, at least one pair of said flanges centrally of the cylindrical member providing an annular recess for clampingly securing and sealably engaging said neck portion of the skin, and another pair of said flanges at end portions of said cylindrical member cooperating with means at respective ends of a cylindrical bore in said head to provide an interlock between the body portion and head restricting head movement to free rotary movement with respect to said neck portion.

2. In a figure toy, a closure means and head mounting as defined in claim 1, wherein the flange at the lower end of said cylindrical member has a diameter greater than the diameter of said bore, all other flanges being of a diameter to freely enter said bore, and said means at the upper end of said bore comprising an upwardly and inwardly inclined circumferential flange adapted to flex over the flange at the upper end of said cylindrical member and to lockingly engage the under surface thereof.

3. In a figure toy, a closure means and head mounting as defined in claim 2, wherein the spacing of the bottom end of said bore and the terminus of said inwardly inclined flange is sufficiently less than the spacing of the upper and lower flanges of said cylindrical member to allow for the skin layer interspaced between said lower flange and head, whereby friction during turning action of the head is minimized but tilting if the head is esentially prevented.

4. In a figure toy, a closure means and head mounting as defined in claim 1, wherein said cylindrical member is closed at the upper end after filling by a plug telescopically interfitting therewith and sealably secured thereto, said plug having a small diameter axial extension providing an air passage which is sealed off when all air has been expelled from within the assemblage.

5. In a figure toy, a closure means and head mounting as defined in claim 1, wherein the diameter of said pair of flanges centrally of said cylindrical member is sufficiently less than the diameter of said bore to allow for layers of said skin over said flanges and avoid friction in the rotary movement of said head.

6. In a figure toy, a closure means and head mounting as defined in claim 5, wherein the neck portion of said skin extends above said central pair of flanges facilitating supplemental annular clamping of the neck portion of said cylindrical member.

* * * * *